US005259432A

United States Patent [19]

Danieli

[11] Patent Number: 5,259,432

[45] Date of Patent: Nov. 9, 1993

[54] SUPPORT FRAME FOR MOVEABLE AWNING

[75] Inventor: Remo C. Danieli, via Deccorati Al Valore Civile #221, 35100 Padova, Italy

[73] Assignees: Remo C. Danieli, Padua, Italy; Olof Martensson, Annapolis, Md.; Jose Santini, San Juan, P.R. ; a part interest

[21] Appl. No.: 800,012

[22] Filed: Nov. 29, 1991

[51] Int. Cl.[5] ..... E04F 10/06

[52] U.S. Cl. ..... 160/66; 52/63; 52/93.1; 160/46; 160/69; 160/78

[58] Field of Search ..... 160/66, 68, 69, 78, 160/46; 52/63, 74, 86, 93, 90; 104/89, 95; 403/292, 295, 306

[56] References Cited

U.S. PATENT DOCUMENTS

| | | | |
|---|---|---|---|
| 30,881 | 12/1860 | Keller | 104/95 |
| 3,101,678 | 8/1963 | Grube | 104/95 |
| 4,259,819 | 4/1981 | Wemyss | 52/86 X |
| 4,433,700 | 2/1984 | Dohet | 52/63 X |
| 4,655,010 | 4/1987 | Arquati | 52/63 |
| 4,754,774 | 7/1988 | Leader | 160/66 X |
| 4,841,688 | 6/1989 | Rinaldi | 52/63 |
| 4,854,363 | 8/1989 | Fouquet | 160/98 |
| 4,997,155 | 3/1991 | Reuter et al. | 403/295 X |

*Primary Examiner*—David A. Scherbel
*Assistant Examiner*—Derek J. Berger
*Attorney, Agent, or Firm*—Brady, O'Boyle & Gates

[57] ABSTRACT

A support frame for a moveable awning having horizontally spaced, cantilevered, extruded tubular frames having curved sections connected to the outer ends thereof and to the upper ends of horizontally spaced vertically extending, extruded tubular uprights. The extruded cantilevered frames, curved sections and extruded uprights all have an elliptical configuration in cross-section which are contiguous. The leading edge of the awning is connected to a trolley assembly having rollers engaging the exterior surfaces of the cantilevered frames, curved sections and uprights. By this construction and arrangement a continuous, smooth track is provided between the roof portion and wall portion to facilitate the extension of the awning and the retraction thereof to the stored position. Each curved section is of one-piece construction made of plastic and bendable when heated to obtain the proper curvature between the sloped cantilevered frames and the uprights. By the construction and arrangement of the support frame a track is provided which is not subject to the accumulation of dirt, debris, and ice, and the one-piece construction of the curved section results in a minimum number of parts required.

16 Claims, 4 Drawing Sheets

A
1
6
7
8
16
19
21
22
25
31
32
33
34
34a
35
36
37
38
39

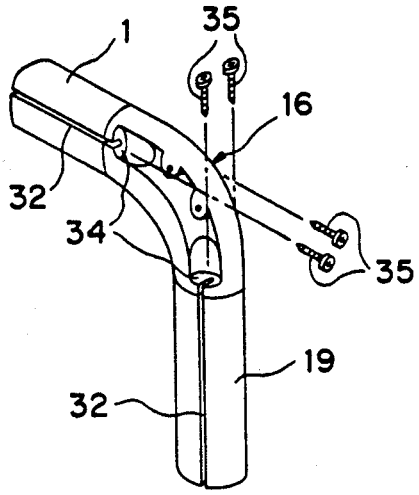
FIG.9
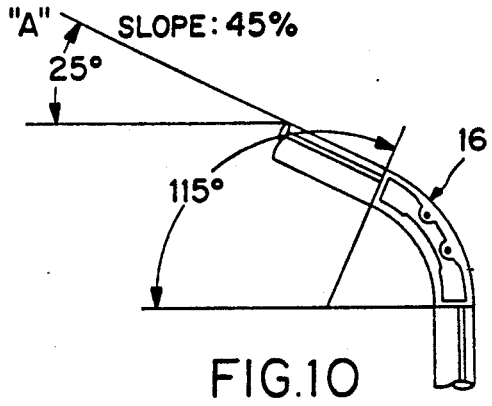
FIG.10
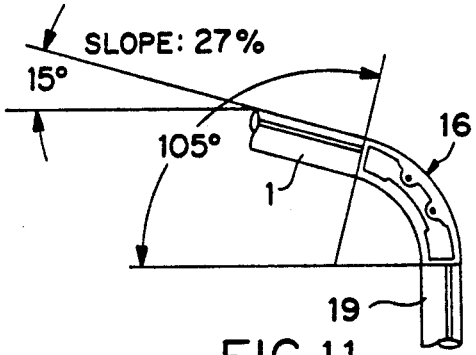
FIG.11
FIG.13
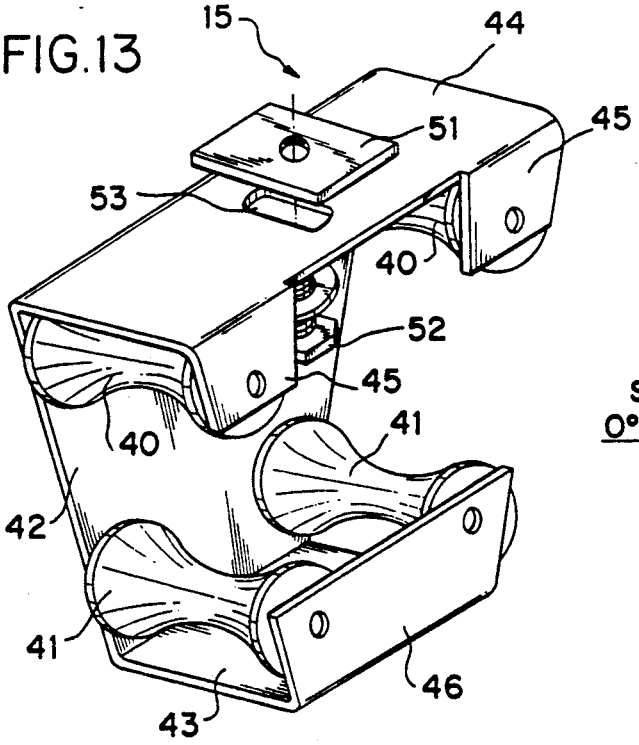
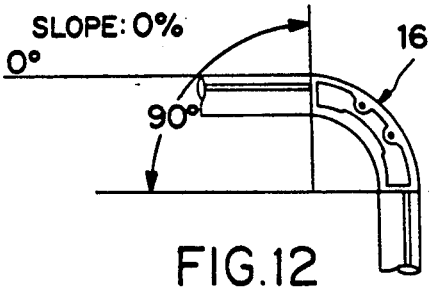
FIG.12

FIG. 14
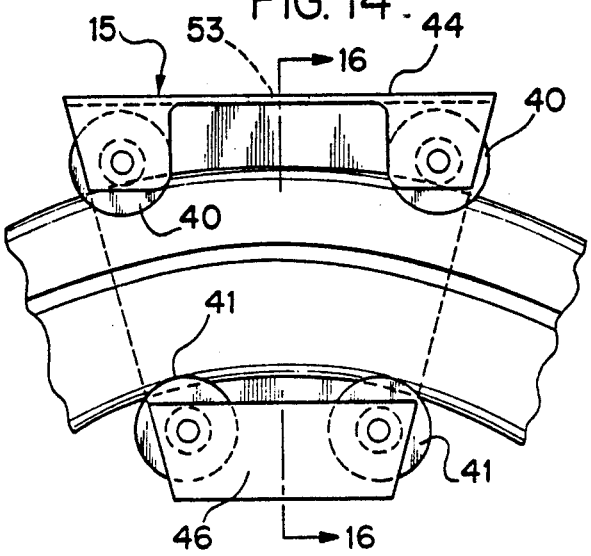
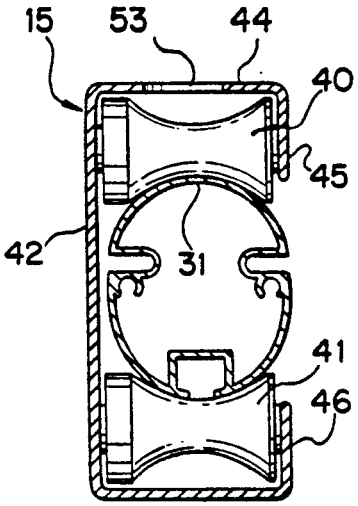
FIG. 16
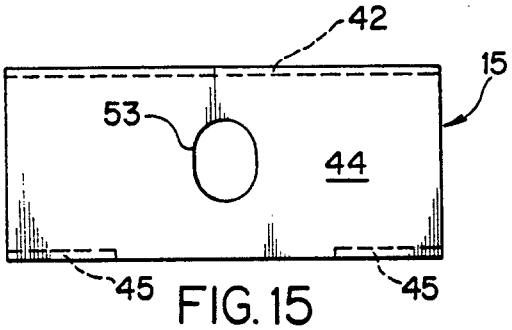
FIG. 15
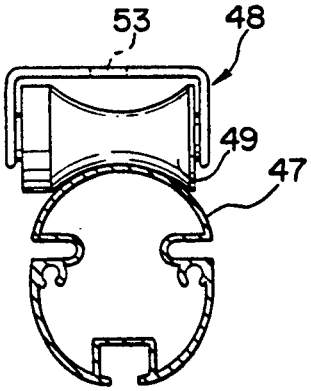
FIG. 17
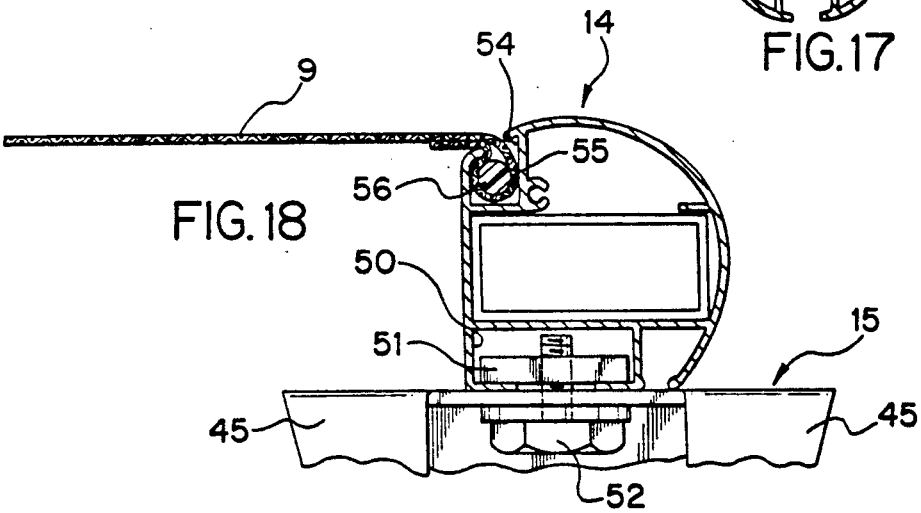
FIG. 18

SUPPORT FRAME FOR MOVEABLE AWNING

BACKGROUND OF THE INVENTION

Various support frames have been proposed for moveable fabric covers such as awnings. Examples of these frames are disclosed in U.S. Pat. Nos. 4,655,010, dated Apr. 7, 1987; and 4,854,363, dated Aug. 8, 1989.

The support frames disclosed in these patents include horizontally spaced, extruded frames attachable at one end to a support structure, such as a building, and extending therefrom in a cantilevered manner. A roll of awning fabric is mounted between and supported by the horizontally spaced guide frames adjacent the building, the free edge of the awning fabric being provided with a roller on each side thereof which travel in channels providing a track in the guide frames, whereby when pulled from the roll, the awning fabric and supporting guide frames form a roof portion. The outer ends of the cantilevered guide frames have curved guide frames connected to a pair of horizontally spaced, vertically extending, ground supported guide frames forming uprights for supporting the roof portion. The curved guide frames and ground supported uprights also have tracks for guiding the free edge of the awning from the roof portion to the uprights, to thereby form a wall portion of awning fabric.

While these support frames have generally been satisfactory for their intended purpose, they have been subject to certain objections. More particularly, the tracks provided in the support frames, upon which the awning carrying rollers travel, are formed by channels which are open to the atmosphere, whereby atmospheric debris such as dirt, dust, and ice accumulate in the channels, thereby impeding the travel of the awning carrying rollers.

In order that the roof portion can be positioned at a desired slope relative to the building, the curved guide frames are adjustable to accommodate the roof portion to the ground supported uprights. The curved guide frame disclosed in U.S. Pat. No. 4,655,010 includes a multi-part joint of overlapping circular plates, adjustable relative to each other, to provide the proper angle.

In U.S. Pat. No. 4,854,363 the curved guide frame includes a plurality of 10° sectors connected together. If the curvature is not correct with standard supplied sectors, the installer cuts a smaller sector on the job to make the correct curvature. The sectors are held together by articulated links which extend through cavities inside the sectors and into the adjoining roof portion and uprights.

An objection to the curved guide frames disclosed in the above-mentioned patents is the often misalignment of the track sections between the roof portion, the curved portion and the wall portion, whereby the awning attached rollers become jammed in the tracks, thereby preventing the awning from being pulled to the fully extended position and retracted to the stored position. Another objection is the number of parts required to make the curved guide frame adjustable and the expertise required of the installer for obtaining the correct curvature.

SUMMARY OF THE INVENTION

After considerable research and experimentation the support frame for a moveable awning of the present invention has been devised to overcome the above-noted disadvantages experienced heretofore in prior awning support frames, and comprises, essentially, horizontally spaced, cantilevered, extruded, tubular frames, having curved sections connected to the outer ends thereof and to the upper ends of horizontally spaced, vertically extending, extruded tubular uprights. The extruded cantilevered frames and the extruded uprights have an elliptical configuration in cross-section and the curved sections also have an elliptical configuration in cross-section corresponding to and contiguous with the elliptical configuration of the cantilevered frames and uprights. The free edge of the awning is provided with a trolley assembly having rollers engaging the exterior surfaces of the cantilevered frames, curved sections and uprights. By this construction and arrangement a continuous, smooth, track is provided between the roof portion and wall portion to facilitate the extension of the awning and the retraction thereof to the stored position.

Each curved section is of one-piece construction made of plastic and bendable when heated to obtain the proper curvature between the sloped cantilevered frames, and the uprights.

By the construction and arrangement of the support frame of the present invention, a track is provided which is not subject to the accumulation of atmospheric dirt and ice, and the one-piece construction of the curved section results in a minimum number of parts required, resulting in a support frame of simplified construction which is not likely to get out of order even after long and continued use.

BRIEF DESCRIPTION OF THE DRAWINGS

FIG. 9 is a perspective view of the curved section being connected to the ends of a cantilevered frame and an upright frame;

FIGS. 10, 11 and 12 are diagrammatic views of the curved section being to a desired angle to accommodate the slope of the cantilevered frame sections;

FIG. 13 is a perspective view of the trolley or carriage to which the free edge of the awning fabric is adapted to be attached;

FIG. 14 is a side elevational view showing the carriage of FIG. 13 supported on a section of the frame;

FIG. 15 is a top plan view of the carriage illustrated in FIG. 14;

FIG. 16 is a view taken along line 16—16 of FIG. 14;

FIG. 17 is a cross-sectional view of an intermediate cantilevered frame section having a carriage rollable thereon for supporting the portion of the awning intermediate its lateral edges; and FIG. 18 is a fragmentary side elevational view illustrating the assembly for connecting the free leading edge portion of the awning fabric to the carriage shown in FIG. 13.

DESCRIPTION OF THE PREFERRED EMBODIMENT

Figure 2:
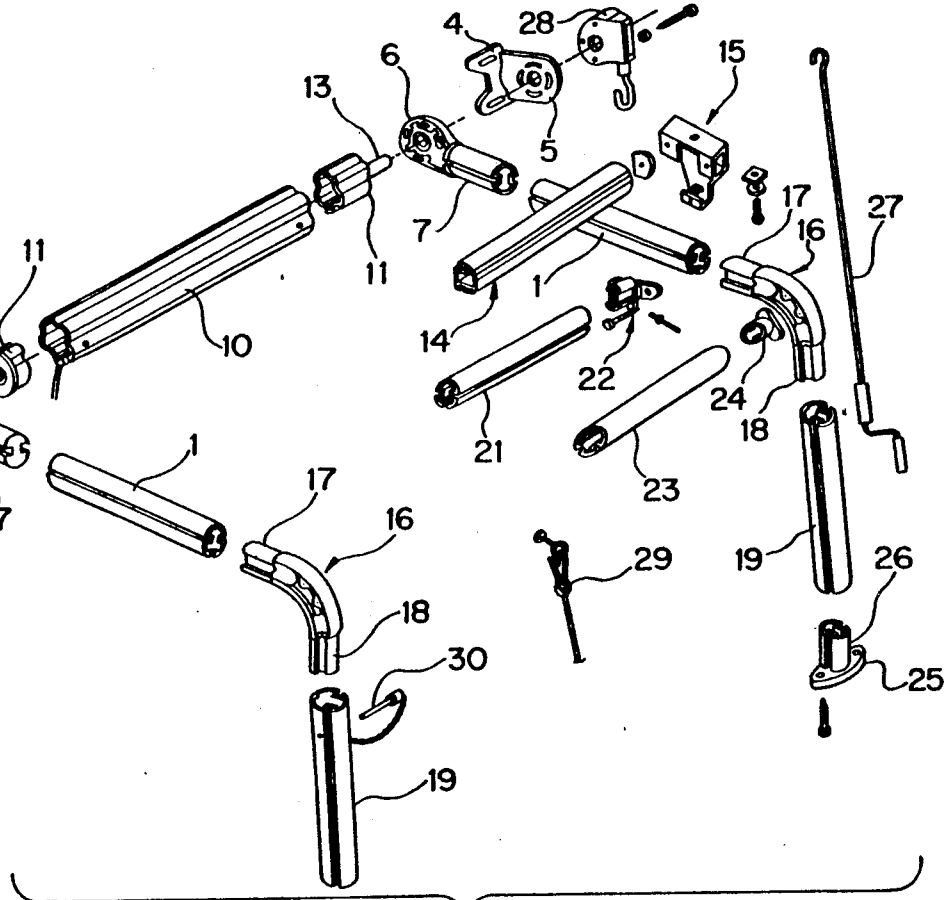
FIG. 2 is an exploded perspective view of the various components of the support frame shown in FIG. 1.
Figure 1:
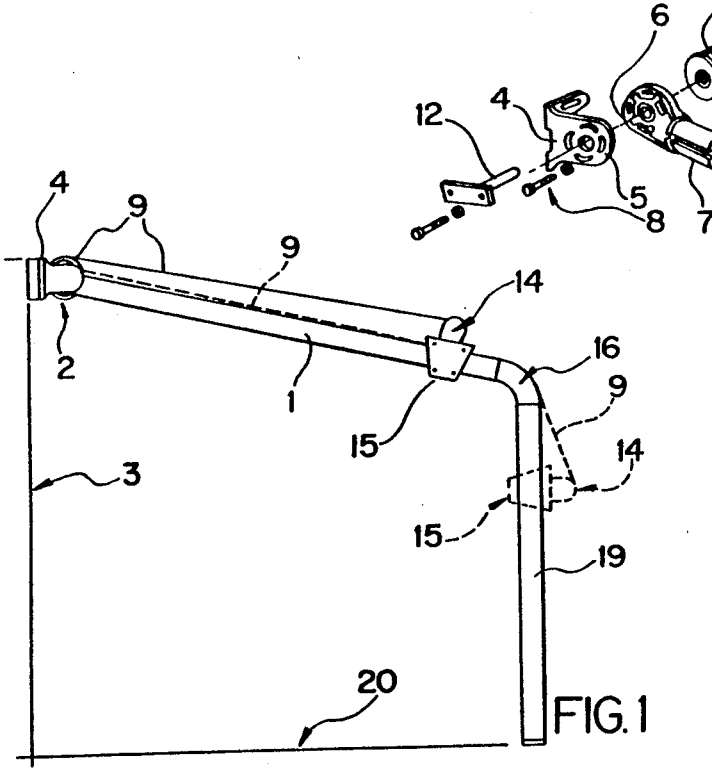
FIG. 1 is a diagrammatic side elevational view of the support frame for a moveable awning of the present invention.

Referring to the drawings and more particularly to FIGS. 1 and 2, the support frame for a moveable awning of the present invention comprises, a pair of horizontally spaced, extruded frame sections 1 attachable as at 2 to a support structure 3, such as a building and extending therefrom in a cantilevered manner. The attachment 2 comprises a pair of spaced brackets 4 secured to the side or fascia of the building 3, each bracket having an apertured circular portion 5, mounted in overlapping relationship with a similar circular portion 6 integral with the end of a plug portion 7 insertable into the end of the frame section 1. Suitable nut and bolt assemblies 8 are provided for holding the circular portions 5 and 6 in overlapping relationship. By this construction and arrangement the circular portion 7 can be rotated relative to circular portion 5 to thereby adjust the slope of the frame section 1 relative to the building 3, the circular portion 6 being held in the adjusted position by the nut and bolt assembly 8.

A roll of awning fabric 9 is wound on a support roll 10 having hub members 11 and supporting support shafts 12 and 13 on each end thereof extending through the circular portions 5 of the brackets, whereby the roll of awning fabric 9 is rotatably supported by the brackets 4. The free edge of the awing fabric is connected to transversely extending extruded frame member 14 having a trolley or carriage 15 mounted on each end thereof and slidable on the frame sections 1, thereby providing a roof portion. The free ends of the cantilevered frame sections 1 are connected to curved sections 16 having plug portions 17 and one end insertable into the free ends of frame section 1, and similar plug portions 18 on the opposite end insertable into the upper open ends of a pair of horizontally spaced, vertically extending extruded uprights 19 having their lower ends supported on the ground 20. By this construction and arrangement, the curved sections provide a continuous surface between the frame sections 1 and the uprights 19, whereby the carriages 15, connected to the free edge portion of the awning can be pulled onto the uprights 19 as shown in phantom in FIG. 1, to thereby provide a wall portion of awning fabric.

To rigidify and stabilize the support frame, a transversely extending, extruded, tubular frame member 21 extends between the frame sections 1 and is attached at its opposite ends to the side of the frame sections 1 by suitable brackets 22, to be described more fully hereinafter. Similarly, another transversely extending, extruded, tubular frame member 23 is connected at its opposite ends to the curved sections 16 by brackets 24. Additional transversely extending, extruded, tubular frame members 21 may be connected between frame sections 1 and on the top portions of uprights 19 as required to stabilize the support frame, and depending upon its size. To complete the stabilization of the support frame, foot members 25 having plug portions 26 insertable into the lower ends of the tubular uprights 19 are provided, the foot members 25 being adapted for anchoring to the supporting ground surface.

To complete the general arrangement of the conventional components employed in the support frame and moveable awning, a handle 27 is provided for rotating the conventional drive mechanism 28 operatively connected to the shaft 13 of the awning roll 9, whereby the awning may be manually unwound from the stored position to the roof and wall forming positions, and rewound therefrom to the stored position. A pull cord 29 can also be provided for operating the awning in a manner similar to a window shade, and a pin 30 tethered to the uprights 19 can be employed for holding the awning in the extended position by inserting the pin into the end of the frame member 14, or the side of one of the carriages 15.

Figures 3, 4, 5, 6, 7, 8:
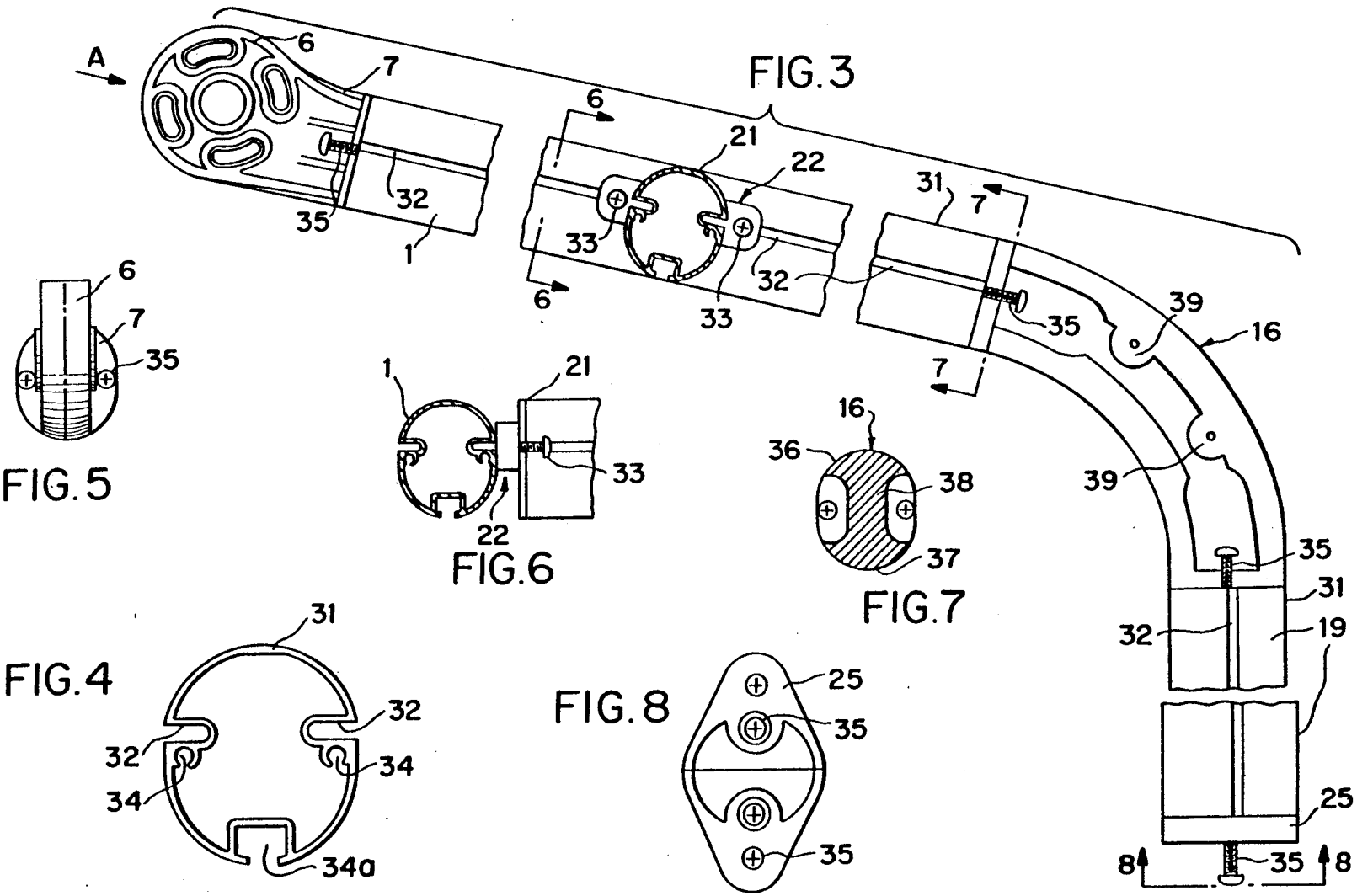
FIG. 3 is a fragmentary, side elevational view showing the sloped cantilevered frame section, the curved section and the upright frame.
FIG. 4 is a detail view of the cross-section of the cantilevered frame section and the upright frame.
FIG. 5 is an end view of the frame assembly looking from the direction of arrow "A" in FIG. 3.
FIG. 6 is a view taken along line 6—6— of FIG. 3.
FIG. 7 is a view taken long line 7—7 of FIG. 3.
FIG. 8 is a view taken along line 8—8 of FIG. 3.

Referring to FIG. 4, the details of the cross-sectional configuration of the tubular sections 1, 16, 21 and 23 are illustrated wherein it will be seen that the sections are substantially elliptical in cross-section having a thickened upper surface 31 upon which the carriage 15 is supported. Recesses or lateral slots 32 extend inwardly from the opposite side walls of the extrusion and extend the length of the section as shown in FIG. 3. The slots 32 provide a receptor for receiving self-tapping screws 33 securing the brackets 22 to the frame section 1, whereby the transversely extending stabilizing frame member 21 is fixedly mounted to the frame sections 1.

The extruded tubular sections are also provided with axially extending arcuate recesses 34 for receiving axially extending self-tapping screws 35, whereby the plug portions 7 of the attachment 2, the plug portions 17 and 18 of the curved section 16 and the foot members 25 are fixedly connected to the respective ends of the frame sections 1 and the uprights 19.

The extruded tubular sections are further provided with a rectangular bottom opening channel 34*a* for slidably receiving a curtain carrier, such as a plurality of sliding plastic clips as in a traverse rod onto which a dividing curtain or wall can be hung.

The cross-sectional configuration of the curved section 16 is illustrated in FIG. 7 wherein it will be seen that it has an elliptical configuration similar to that of the tubular sections 1 and 19 having enlarged arcuate upper and lower portions 36, 37 interconnected by a web portion 38, forming a generally I-beam cross-section. When connected between the tubular sections 1 and 19 the upper surface 36 is contiguous with the upper surface 31 of the tubular sections 1 and 19 to thereby provide a continuous surface upon which the carriage can travel.

As will be seen in FIG. 3, the side of the curved section 16 is provided with a pair of apertured ears 39 for receiving mounting screws whereby the transverse tubular frame member 23 (FIG. 2) and associated mounting bracket 24 are secured to the curved sections 16.

The details of the construction of the carriage 15 are illustrated in FIG. 13 wherein it will be seen that a pair of upper hyperbolic rollers 40 and a pair of lower hyperbolic rollers 41 are rotatably mounted in a C-shaped housing comprising a side wall 42, a bottom wall 43, a top wall 44, the opposite ends of the upper rollers being journalled in the side wall 42 and ear members 45 depending from the top wall, the opposite ends of the lower rollers 41 being journalled in the side wall 42 and a flange 46 extending upwardly from the bottom wall 43. By this construction and arrangement the carriage 15 is supported on the tubular extrusion as shown in FIG. 16, wherein the upper rollers 40 are supported by the upper enlarged surface 31 of the extrusion and the lower rollers 41 engage the lower surface of the tubular extrusion, whereby the carriage 15 is held captive onto the tubular extrusion.

In some instances, when there is a large lateral distance between the frame sections 1, 16 and 19, the portion of the awning intermediate its lateral edges requires a support. In this instance, an additional extruded tubular section 47, as shown in FIG. 17, is provided which would be positioned in the space intermediate the pair of sections 1, 16 and 19, shown in FIG. 2; in other words, a duplicate of the sections 1, 16 and 19 would be employed so as to provide three laterally spaced frame sections. The intermediate portion of the awning end support and frame member 14 would be supported on a carriage 48 having a pair of rollers 49 supported on the upper surface of the intermediate tubular extrusion 47.

The details of the transversely extending extruded, tubular awning end support frame member 14 are shown in FIG. 18 wherein it will be seen that the tubular frame member includes a bottom channel portion 50 for receiving a nut 51 through which an upwardly extending bolt 52 is threadably secured, the bolt extending through an aperture 53 (FIG. 13) provided in the top wall 44 of carriage 15. The tubular frame member 14 is also provided with an entrant portion 54 for receiving the leading edge of the awning fabric 9 which is provided with a loop or hem 55 through which a suitable anchoring rod 56 extends to thus rigidly anchor the leading edge of the awning to frame member 14.

It will be readily appreciated by those skilled in the art that the awning support frame thus far described provides an improved track upon which the carriages 15 and 48 are smoothly guided since there is no open channel where atmospheric debris can accumulate to impede the travel of the rollers 40, 41 and 49 on the exterior elliptical surfaces of the tubular extrusions. Furthermore, the recesses 32 and 34 formed integral with the extrusion function as the nut portion of the fastener for assembling the frame components, thus minimizing the number of parts required for assembling the frame support.

Another feature of the frame support of the present invention resides in the curved section 16 which is bendable, as shown in FIGS. 10, 11 and 12, through an angle of approximately plus or minus 15°, from the supplied position shown in FIG. 11, to accommodate the desired slope of the awning roof. To this end, the curved section 16 is made of plastics material, such as polyamide resins, i.e. nylon, and is molded to have an initial curvature as shown in FIG. 11, of approximately 105°. If it is desired to change the angle of curvature of the curved section 16, it is merely heated by a portable heater, such as a heat gun or hair dryer, to a temperature in the range of 290° F. to 310° F., preferably approximately 300° F., wherein the plastic becomes pliable enough to be manually bent to the desired angle of curvature and will remain there when the temperature is lowered during cooling, whereby all stresses in the bent section 16 are relieved. The generally I-beam cross-sectional shape of curved section 16, as shown in FIG. 7, allows the curved section to be quickly and easily heating throughout its thickness, so it can be easily, smoothly, and expertly bent to the proper angle by an unskilled person doing it for the first time.

It will be readily apparent to those skilled in the art that curved section 16 provides a smooth track section between tubular section 1 and uprights 19, and can be easily bent by an unskilled person to accommodate various sloped awning roofs; thus precluding the necessity of a multi-part joint as required heretofore. This structure thus readily lends itself to the do-it-yourselfer.

The terms and expressions which have been employed herein are used as terms of description and not of limitation, and there is no intention, in the use of such terms and expressions, of excluding any equivalents of the features shown and described or portions thereof, but it is recognized that various modifications are possible within the scope of the invention claimed.

I claim:

1. A frame for supporting a moveable awning comprising, a pair of horizontally spaced tubular frame sections, means for attaching one end of each frame section to the side of a building a substantial distance above the ground, whereby the frame sections extend outwardly from the building in a cantilevered manner, a pair of laterally spaced one-piece curved sections, the opposite end of each cantilevered frame section being connected to one end of a respective curved section, a pair of horizontally spaced, substantially vertically extending tubular uprights, the upper end of each upright being connected to the opposite end of a respective curved section, the lower end of each upright being supported on the ground, said tubular frame sections, curved sections, and tubular uprights having corresponding contiguous, cross-sectional configurations, and corresponding contiguous top and bottom outer surfaces forming continuous top and bottom outer track surfaces, a roll of awning fabric extending laterally between the ends of said frame section in proximity to the building, said roll being operatively connected to the attaching means, a transversely extending tubular frame member extending between the tubular frame sections, the awning fabric having a leading edge connected to said tubular frame member, carriage means connected to each end of said tubular frame member, said carriage means having rollers supported on the top and bottom outer track surfaces of said tubular frame sections; to thereby facilitate the travel of the carriage means and associated awning fabric on the support frame whereby the awning fabric forms a roof portion supported by the frame sections, and a wall portion supported by the curved sections and tubular uprights.

2. A frame for supporting a moveable awning according to claim 1, wherein the carriage means comprises a housing, a first pair of rollers mounted in said housing, and a second pair of rollers mounted in said housing above said first pair of rollers, the first pair of rollers engaging the bottom outer track surfaces of the tubular frame section, curved section and tubular upright, and said second pair of rollers engaging the top outer track surfaces of the tubular frame section, curved section and tubular upright.

3. A frame for supporting a moveable awning according to claim 2, wherein said second pair of rollers are spaced from each other a greater distance than the spacing between said first pair of rollers.

4. A frame for supporting a moveable awning according to claim 1, wherein a stabilizing tubular frame member extends transversely between the tubular frame sections, a mounting bracket connected to each end of the stabilizing frame member, a longitudinally extending recess formed in the side wall of each tubular frame section, and self-tapping screws extending between the mounting bracket and the recess for securing the bracket to the respective tubular frame section.

5. A frame for supporting a moveable awning according to claim 1, wherein the tubular frame sections, curved sections, and tubular uprights have an elliptical cross-sectional configuration, the carriage means comprises a housing, a first pair of rollers mounted in said housing, and a second pair of rollers mounted in said housing above said first pair of rollers, said rollers having a hyperbolic configuration cooperating with the elliptical cross-sectional configuration of the tubular frame sections, curved sections and tubular uprights, the first pair of rollers engaging the bottom outer arcuate surface of the top and bottom elliptical track surfaces, and the second pair of rollers engaging the top outer arcuate surface of the top and bottom track surfaces, whereby the carriage means is held on the track.

6. A frame for supporting a moveable awning according to claim 1, wherein an intermediate tubular frame section is positioned in the space intermediate the horizontally spaced tubular frame sections, means for attaching one end of said intermediate tubular frame section to the side of the building, whereby the intermediate tubular frame section extends outwardly from the building in a cantilevered manner, a further one-piece curved section, the opposite end of the cantilevered intermediate frame section being connected to one end of said further curved section, a vertically extending further tubular upright, the upper end of said further upright being connected to the opposite end of said further curved section, the lower end of said further upright being supported on the ground, further carriage means connected to said transversely extending tubular frame member intermediate the ends thereof, said further carriage means having rollers engaging the top outer surface of said intermediate tubular frame section, further curved section and further tubular upright, whereby the awning is supported on the frame intermediate the lateral edges thereof.

7. A frame for supporting a moveable awning comprising, a pair of horizontally spaced tubular frame sections, means for attaching one end of each frame section to the side of a building a substantial distance above the ground, whereby the frame sections extend outwardly from the building in a cantilevered manner, a pair of laterally spaced one-piece curved sections, the opposite end of each cantilevered frame section being connected to one end of a respective curved section, a pair of horizontally spaced, substantially vertically extending tubular uprights, the upper end of each upright being connected to the opposite end of a respective curved section, the lower end of each upright being supported on the ground, a roll of awning fabric extending laterally between the ends of said frame sections in proximity to the building, said roll being operatively connected to the attaching means, a transversely extending tubular frame member extending between the tubular frame sections, the leading edge of the awning fabric being connected to said tubular frame member, carriage means connected to each end of said tubular frame member, said carriage means having rollers supported on the outer surfaces of said tubular frame sections, curved sections and tubular uprights; said tubular frame sections, curved sections, and tubular uprights having corresponding contiguous, elliptical cross-sectional configurations, said one-piece curved sections having I-shaped cross-sections with elliptically curved top and bottom surfaces, to thereby provide a continuous track on the outer surfaces thereof to facilitate the travel of the carriage means and associated awning fabric on the support frame whereby the awning fabric forms a roof portion supported by the frame sections, and a wall portion supported by the uprights.

8. A frame for supporting a moveable awning according to claim 7, wherein the ends of the curved sections being formed as plug portions insertable into the respective ends of the tubular frame sections and tubular uprights.

9. A frame for supporting a moveable awning according to claim 8, wherein each tubular frame section and tubular upright is formed with axially extending arcuate recesses, axially extending screw holes formed in the plug portions of each curved section, said screw holes being aligned with said arcuate recesses, and screws extending through the holes and recesses for securing the opposite ends of the curved section to the respective ends of the tubular frame section and the tubular upright.

10. A frame for supporting a moveable awning according to claim 9, wherein said recesses are formed in opposite sides of said one-piece curved sections by said I-shaped cross-section, said side recesses being axially aligned with said axially extending screw holes in the plug portions, and with said arcuate recesses, whereby said screws extend axially in said side recesses through the holes and recesses.

11. A frame for supporting a moveable awning according to claim 7, wherein the means for attaching the frame sections to the building is adjustable whereby the slope of the frame sections can be varied, the one-piece curved sections being bendable to accommodate the sloped frame sections to the uprights.

12. A frame for supporting a moveable awning according to claim 11, wherein each curved section is made of plastic which is manually bendable to a desired angle when heated to a temperature in the range of 290° F. to 310° F.

13. A frame for supporting a moveable awning according to claim 11, wherein each one-piece curved section is made of plastics material which is manually bendable to a desired angle.

14. A frame for supporting a moveable awning according to claim 11, wherein each one-piece curved section is made of a polyamide plastics material which is manually bendable to a desired angle when heated.

15. A frame for supporting a moveable awning according to claim 14, wherein said one one-piece curved section is heated to approximately 300° F. before manually bending.

16. A frame for supporting a moveable awning according to claim 7, wherein said one-piece curved sections are made of plastics material and are manually bendable at least in the approximate range of plus or minus 15°, whereby said frame sections can extend outwardly from the building at a desired angle.

* * * * *